US005454563A

United States Patent [19]

Nagamoto et al.

[11] Patent Number: 5,454,563

[45] Date of Patent: Oct. 3, 1995

[54] GOLF CLUB

[75] Inventors: Itsushi Nagamoto; Atsushi Tsuchida, both of Shizuoka, Japan

[73] Assignee: Yamaha Corp., Japan

[21] Appl. No.: 273,832

[22] Filed: Jul. 12, 1994

[30] Foreign Application Priority Data

Jul. 13, 1993 [JP] Japan ..... 5-195276

[51] Int. Cl.[6] ..... A63B 53/02

[52] U.S. Cl. ..... 273/80.2; 273/80.4; 273/80.8

[58] Field of Search ..... 273/80.1, 80.2, 273/80.3, 80.4, 80.5, 80.6, 80.7, 80.8, 80.9, 167 R, 77 R

[56] References Cited

U.S. PATENT DOCUMENTS

| | | | |
|---|---|---|---|
| 1,643,754 | 9/1927 | Sleith | 273/80.3 |
| 1,958,032 | 5/1934 | Cocke | 273/80.2 |
| 2,093,837 | 9/1937 | Hiscocks | 273/80.3 |
| 2,121,387 | 6/1938 | Houser | 273/80.3 |
| 3,572,709 | 3/1971 | Risher | 273/80.2 |
| 3,873,090 | 3/1975 | Thompson | 273/80.3 |
| 3,907,446 | 9/1975 | Leslie | 273/80.2 |
| 4,417,731 | 11/1983 | Yamada | 273/80.4 |
| 4,438,931 | 3/1984 | Motomiya | 273/80.2 |
| 5,226,652 | 7/1993 | Sato | 273/80.2 |

FOREIGN PATENT DOCUMENTS

| | | | |
|---|---|---|---|
| 341749 | 1/1931 | United Kingdom | 273/80.8 |

*Primary Examiner*—Sebastiano Passaniti
*Attorney, Agent, or Firm*—Ostrolenk, Faber, Gerb & Soffen

[57] ABSTRACT

In construction of a golf club in which a shaft is fixed along its lower tip to a main body within a shaft hole formed in a hosel of the main body, an elongated cylindrical core is inserted into the lower tip of the shaft whilst projecting beyond the upper end location of the hosel. Presence of the cylindrical core well fortifies a shaft/hosel joint whilst withstanding impact is generated at shooting balls.

5 Claims, 3 Drawing Sheets

GOLF CLUB

BACKGROUND OF THE INVENTION

The present invention relates to a golf club, and more particularly relates to improvements in a joint structure between a shaft and hosel of a wood- or iron- type golf club.

In a typical construction of a shaft/hosel joint of a conventional golf club, a shaft is fixed along it lower tip to a main body hosel within a shaft hole formed in the latter via an intermediate bond layer. More specifically, a main body of a golf club is provided at one squeezed or tapered end with a tubular hosel defining a shaft hole which extend upwards when the golf club is held in position. The tapered lower tip of a shaft is inserted into the shaft hole in the hosel and the shaft tip is fixed to the hosel via an intermediate bond layer within the shaft hole. Near the upper end of the hosel, the shaft/hosel joint is fortified by an embracing conical, tubular protector generally made of plastics.

In the case of such a conventional shaft/hosel structure, undesirable stress concentration is apt to occur around the border between the hosel and the protector due to impact at shooting balls. Buckling and/or compressire destruction accruing from such stress concentration often causes dangerous breakage of the shaft at the very moment of shooting balls. In particular in the case of a so-called short-neck type golf club including a relatlvely short hosel, poor holding of the shaft by the hosel tends to cause such breakage of the shaft due to impact generated by shooting balls.

In addition, the area of contact between a hosel and a shaft is rather small in the case of such a short-neck type golf club and poor holding by such a reduced area of contact allows easy destruction of the intermediate bond layer, which tends to dangerous separation of the shaft from the hosel when the former is swung for shooting balls.

SUMMARY OF THE INVENTION

It is the basic object of the present invention to provide a golf club having high level of endurance of its shaft/hosel joint against ball shooting impact through minimization in the above-described stress concentration and bond layer destruction.

In accordance with the basic aspect of the present invention, in the shaft/hosel joint of the above-described type, an elongated, cylindrical core is inserted into a shaft tip while projecting beyond the upper end location of an associated hosel. and bond layers are present between the shaft tip and the cylindrical core as well as between the shaft tip and the hosel.

In one preferred embodiment of the golf club in accordance with the present invention, the cylindrical core extends beyond the lower end of the hosel.

In another preferred embodiment of the golf club in accordance with the present invention, the cylindrical core is joined to said hosel at the lower end of a shaft hole formed in the hosel.

In a further preferred embodiment of the golf club in accordance with the present invention, annular serrations are formed in the outer surface of the cylindrical core.

DESCRIPTION OF THE PREFERRED EMBODIMENTS

Figure 1:
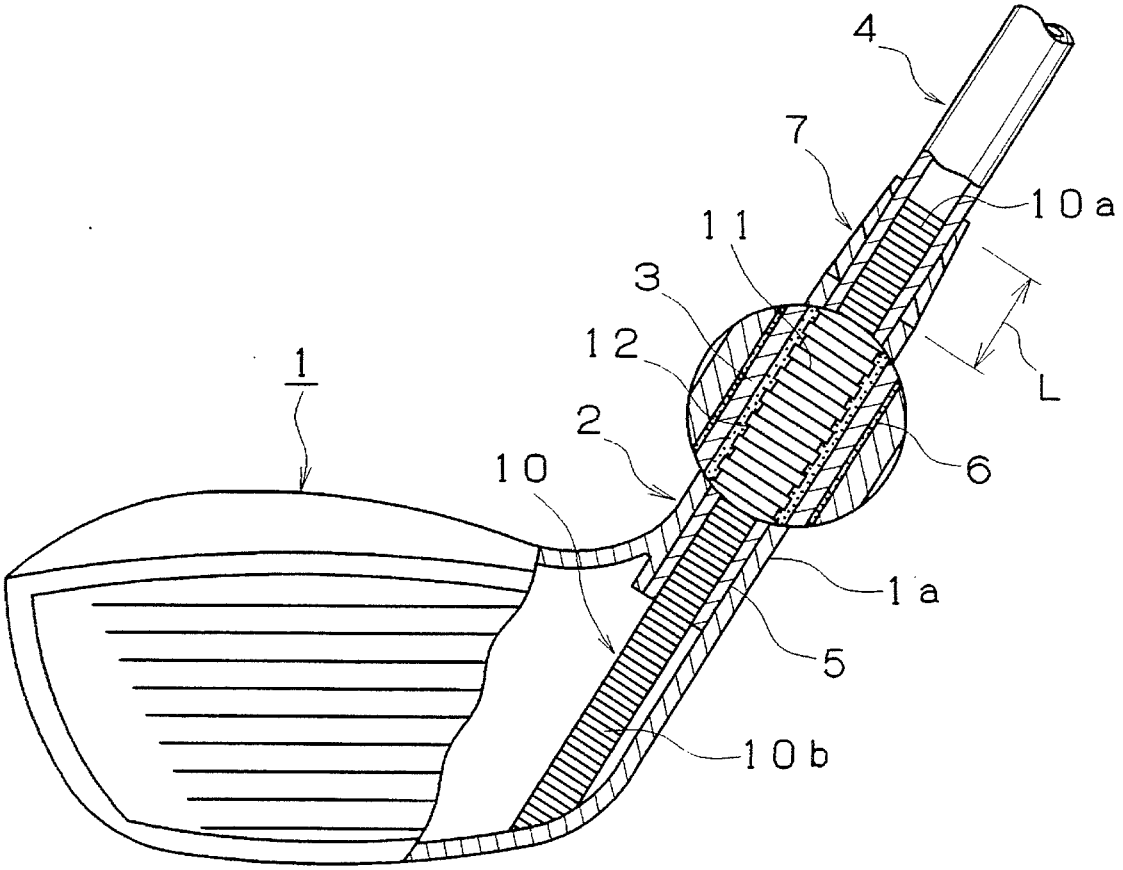
FIG. 1 is a side view, partly in section and partly enlarged, of the first embodiment of the golf club in accordance with the present invention.

One embodiment of the golf club in accordance with the present invention is shown in FIG. 1, in which a main body 1 merges at its neck la into a hosel 2 provided with a shaft hole 3 open at its upper end. An elongated cylindrical core 10 is idly inserted into the shaft hole 3 whereas its upper end section 10*a* projects beyond the upper end location of the hosel 2. Preferably, the length of projection (L) is 3 mm or larger.

The cylindrical core 10 is preferably made of metals, fiber reinforced plastics such as CFRP and GFRP or high tenacity synthetic resins. Further preferably, annular setrations 11 are formed in its outer surface. The lower end section 10*b* of the cylindrical core 10 is fused or melt bonded to the inner wall 1*b* of the sole of the main body 1 in the case of the illustrated embodiment.

The tip 5 of an associated shaft 4 is inserted over the cylindrical core 10 within the shaft hole 3 in the hosel 2 and a bond layer 12 is present between the shaft tip 5 and the cylindrical core 10. Another bond layer 6 is present between the shaft tip 5 and the hosel 2. At a position beyond the upper end of the hosel 2, the shaft tip 5 is tightly embraced by a protector 7 as in the case of a conventional golf club.

Thank to insertion of the cylindrical core 10, the shaft tip 5 is firmly held between the hosel 2 and the cylindrical core 10 while well withstanding impact at shooting balls. Projection of the cylindrical core 10 beyond the upper end location of the hosel 2 well dissipates stress generated by shooting balls and reduced stress concentration promises elongated life of the shaft. In addition, presence of the serration 11 in the outer surface of the cylindrical core 10 assures high bonding strength between the shaft tip 5 and the cylindrical core 10 thereby well preventing accidental separation of the shaft 4 from the main body 1.

Figure 2:
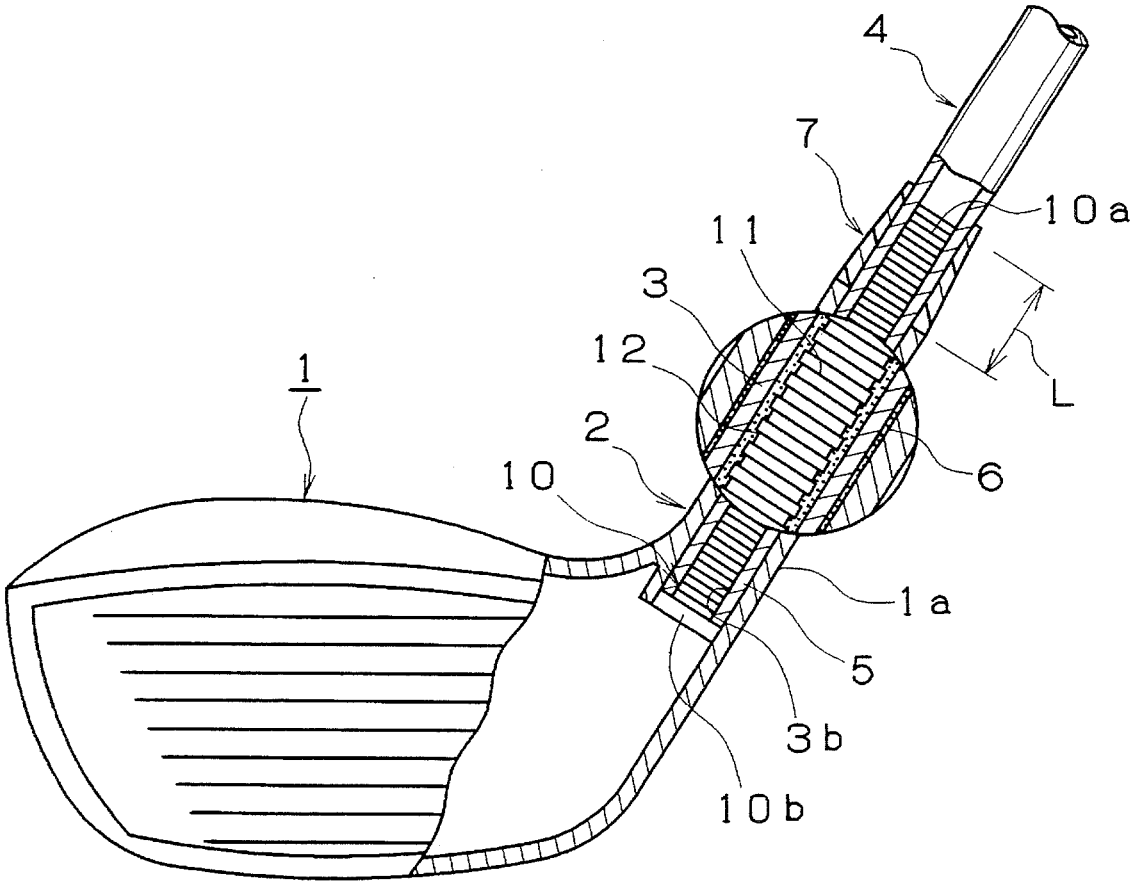
FIG. 2 is a side view, partly in section and partly enlarged, of the second embodiment of the golf club in accordance with the present invention.

The second embodiment of the golf club in accordance with the present invention is shown in FIG. 2. The shaft/hosel joint structure of this embodiment differs from that shown in FIG. 1 in that the lower end of the cylindrical core 10 terminates around the lower end of the shaft hole 3 in the hosel 2. That is, the lower end 10*b* of the cylindrical core 10 is equal in diameter to the shaft hole 3 and joined via fusion or melt bonding to the lower end 3*b* of the shaft hole 3.

Figure 3:
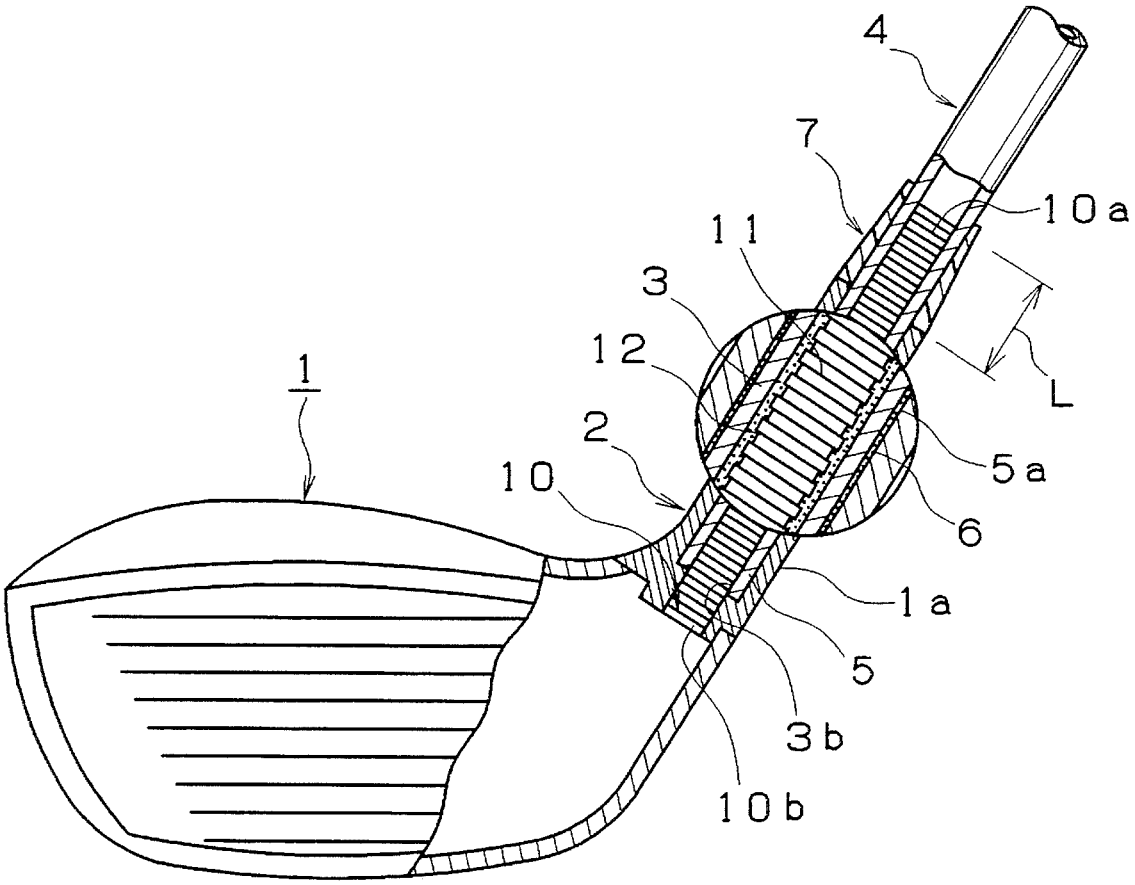
FIG. 3 is a side view, partly in section and partly enlarged, of the third embodiment of the golf club in accordance with the present invention.

In the case of the third embodiment of the golf club shown in FIG. 3, the hosel 2 is formed separately from the main body 1 and the lower end section 10*b* of the cylindrical core 10 is fixed to the lower end section of such a separate hosel 2.

Although the hose12 of the foregoing embodiments has a uniform wall thickness over its entire length, the outer surface of the hosel 2 may converge conically towards the upper end thereof. Alternatively, the hosel 2 may be provided with an wavy outer surface. Further, local cutouts or grooves may be formed in the upper end section of the hosel in order to reduce the rigidity in that region. Such reduction in rigidity, in particular when combined with use of the elongated cylindrical core, also well evades undesirable stress concentration on the associated shaft to prevent accidental breakage.

Separate preparation of the hosel 2 in the third embodiment allows easy and precise mounting of the elongated cylindrical core.

We claim:

1. A golf club, comprising:

a hosel at one end of a main body of said golf club and provided with a shaft hole;

a shaft having a lower tip inserted into said shaft hole in said hosel;

an elongated cylindrical core inserted into said lower tip of said shaft while extending upwards beyond an upper end of said hosel, said cylindrical core having annular serrations formed on the outer surface thereof; and intermediate bond layers arranged between said lower tip of said shaft and said cylindrical core as well as between said lower tip of said shaft and said hosel.

2. A golf club as claimed in claim 1 in which said elongated cyllndrical core extends beyond a lower end of said hosel and has a lower end fixed to an inner wall of a sole of said main body.

3. A golf club as claimed in claim 1 in which a lower end of said elongated cylindrical core terminates at a lower end of said shaft hole and is fixed to said shaft hole.

4. A golf club as claimed in claim 1 in which said cylindrical core is made of a material selected from the group consisting of metals, fiber reinforced plastics and high tenacity synthetic resins.

5. A golf club as claimed in claim 1, in which a lower end of said cylindrical core is fixed to said hosel.

* * * * *